US006117050A

United States Patent [19]

Mankovtiz

[11] Patent Number: 6,117,050

[45] Date of Patent: Sep. 12, 2000

[54] EXERCISE APPARATUS FOR USE WITH CONVENTIONAL CHAIRS

[76] Inventor: Roy J. Mankovtiz, 24236 Park Granada, Calabasas, Calif. 91302

[21] Appl. No.: 09/389,665

[22] Filed: Sep. 1, 1999

Related U.S. Application Data

[63] Continuation of application No. 09/130,859, Aug. 7, 1998.
[60] Provisional application No. 60/055,436, Aug. 7, 1997.

[51] Int. Cl.[7] ..... A63B 71/00
[52] U.S. Cl. ..... 482/8; 482/9
[58] Field of Search ..... 482/1–9, 900–902

[56] References Cited

U.S. PATENT DOCUMENTS 5,410,472 4/1995 Anderson ..... 482/9
5,803,870 9/1998 Buhler ..... 482/9
5,890,997 4/1999 Roth ..... 482/9
5,916,063 6/1999 Alessandri ..... 482/9

*Primary Examiner*—Glenn E. Richman
*Attorney, Agent, or Firm*—Christie, Parker & Hale, LLP

[57] ABSTRACT

Exercise apparatus for attachment to a chair having a center support post. The apparatus has a foot support, wheels mounted on the respective ends of the foot support for rolling on a floor, and a resilient member that exerts resistance as the foot support is moved. One or more sensors are coupled to the wheels for monitoring a user's body functions during exercise. The sensors provide inputs to software in the user's computer that calculate the level of the user's exercise activity as the user is at work on his/her computer. The results are displayed on the computer's monitor.

14 Claims, 4 Drawing Sheets

Fig. 1

OFFICIZER SETUP

REMINDER INTERVAL _____ MIN

AGE _____ YRS WEIGHT _____ LBS

WORKOUT LEVEL: LO ___ MED ___ HIGH ___

RESISTANCE LEVEL:

LO (GRN) _____ MED (BLU) _____ HI (RED) _____

YOUR TARGET HEART RATE IS 140 BPS

Fig. 2

OFFICIZER REMINDER

DATE: 05/01/96 TIME: 10:30 AM

TIME TO DO 20 REPS

ENTER FINAL COUNTER VALUE _____

Fig. 3

OFFICIZER DAILY SUMMARY

TODAY, MAY 1, 1996, YOU HAVE PERFORMED 200 REPS AND BURNED 175 CALORIES

EXERCISE APPARATUS FOR USE WITH CONVENTIONAL CHAIRS

CROSS-REFERENCE TO RELATED APPLICATIONS

This application is a continuation of application Ser. No. 09/130,859 filed Aug. 7, 1998, which claims the benefit of provisional application Ser. No. 60/055,436 filed Aug. 7, 1997.

The disclosure of application Ser. No. 08/441,940 filed May 16, 1995, which describes a product called Officizer, is incorporated fully herein by reference.

BACKGROUND OF THE INVENTION

In any exercise, it is desirable to provide the user with monitoring and feedback information to encourage use. Modern exercise equipment incorporate computer electronics to monitor and display exercise progress as well as user parameters.

In the case of Officizer, where the user is likely to be an office worker using a PC while exercising, the idea is to use the PC for the monitoring and feedback tasks as follows. The user is provided with software designed to operate in a multi-tasking environment, such as Windows 95 or Mac. The software may be in the form a floppy, CD-ROM, or downloaded from a web site. Once loaded and run, the software presents the user with a setup screen as shown in FIG. 1.

As part of setup, the user indicated the time interval at which he/she is to be reminded to exercise during the work day, enter his age, weight and desired workout level. The user also specifies the resistance level being used in the Officizer apparatus. It is contemplated that the Officizer will be supplied with at least three sets of resilient, color coded members having different coefficients of elasticity. Given this information, the program calculates the maximum heart rate (based on age in a manner well known in the art), and determines and displays a target heart rate as a percent of maximum, where the percentage is based on the specified workout level.

Figure 4:
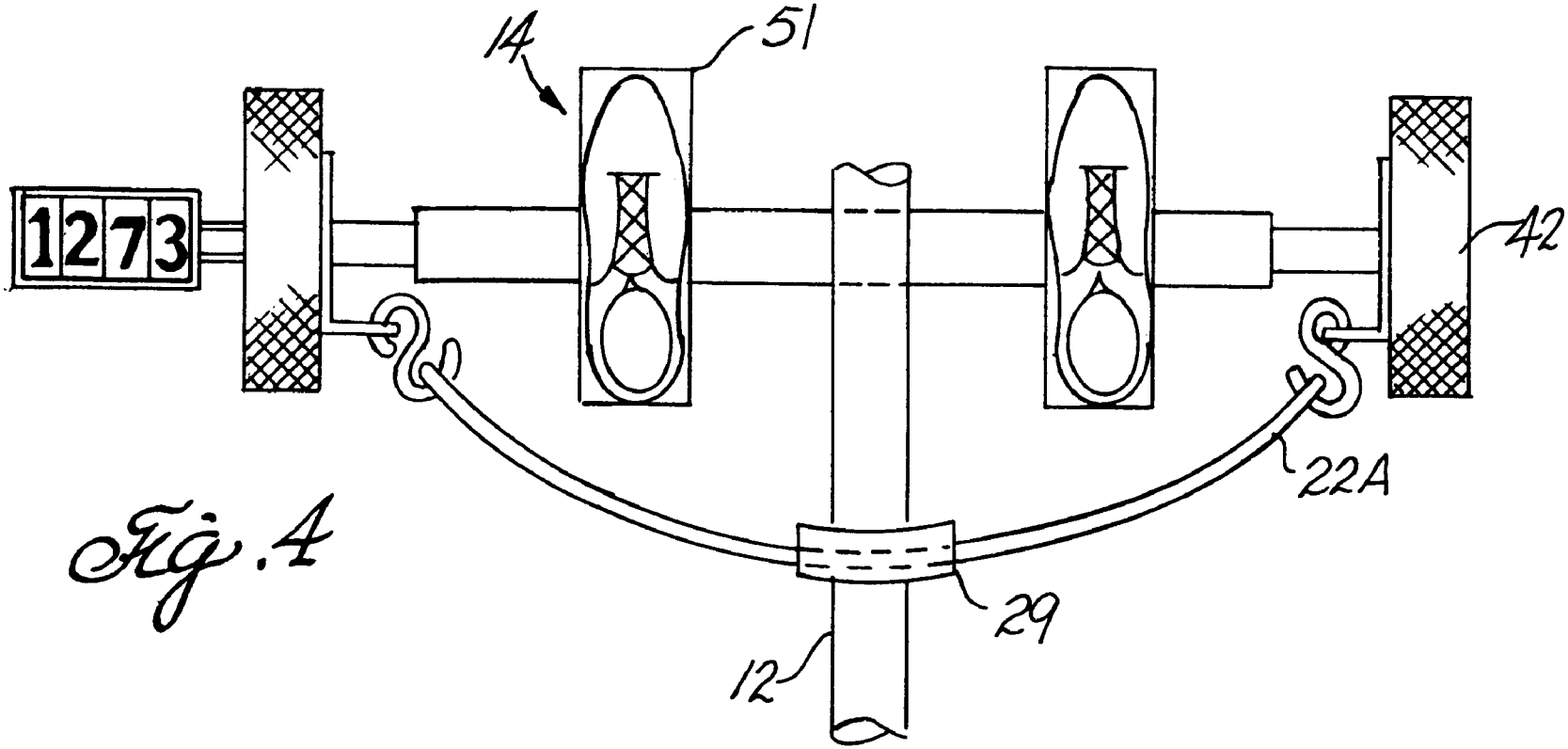

After the program is set up, it operates in the background, and pops up a reminder screen as shown in FIG. 2 at the time intervals specified by the user. The reminder sets a number of reps determined by the workout level. As shown in FIG. 4, the Officizer apparatus is equipped with a counter attached to one wheel. The counter counts the number of revolutions of the wheel in the direction away from the chair. A ratchet is provided so that the retraction motion is not counted. The program includes algorithms that convert wheel rotations into linear distance, and which also calculate the force needed to extend the resilient members a given distance. The force vs. distance curves for these members is not a constant, and the program contains the data to accurately calculate total force expended. Using the user's weight, the program can also calculate the calories expended over time. As shown in FIG. 2, the user is asked to enter the final counter value after each set. At the end of the day, the program displays a screen showing the total number of reps and the calories expended.

Figure 5:
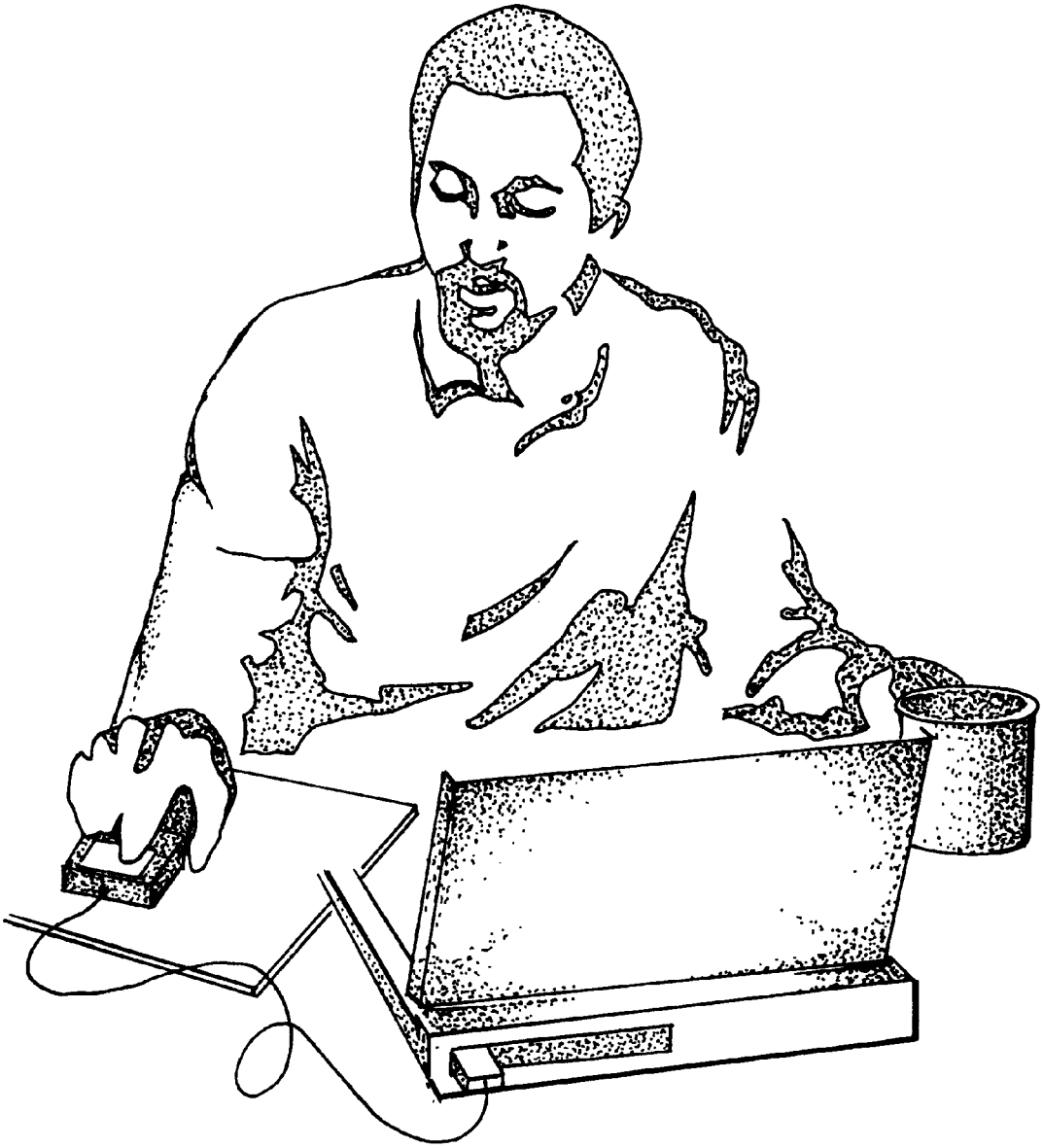
Figure 6:
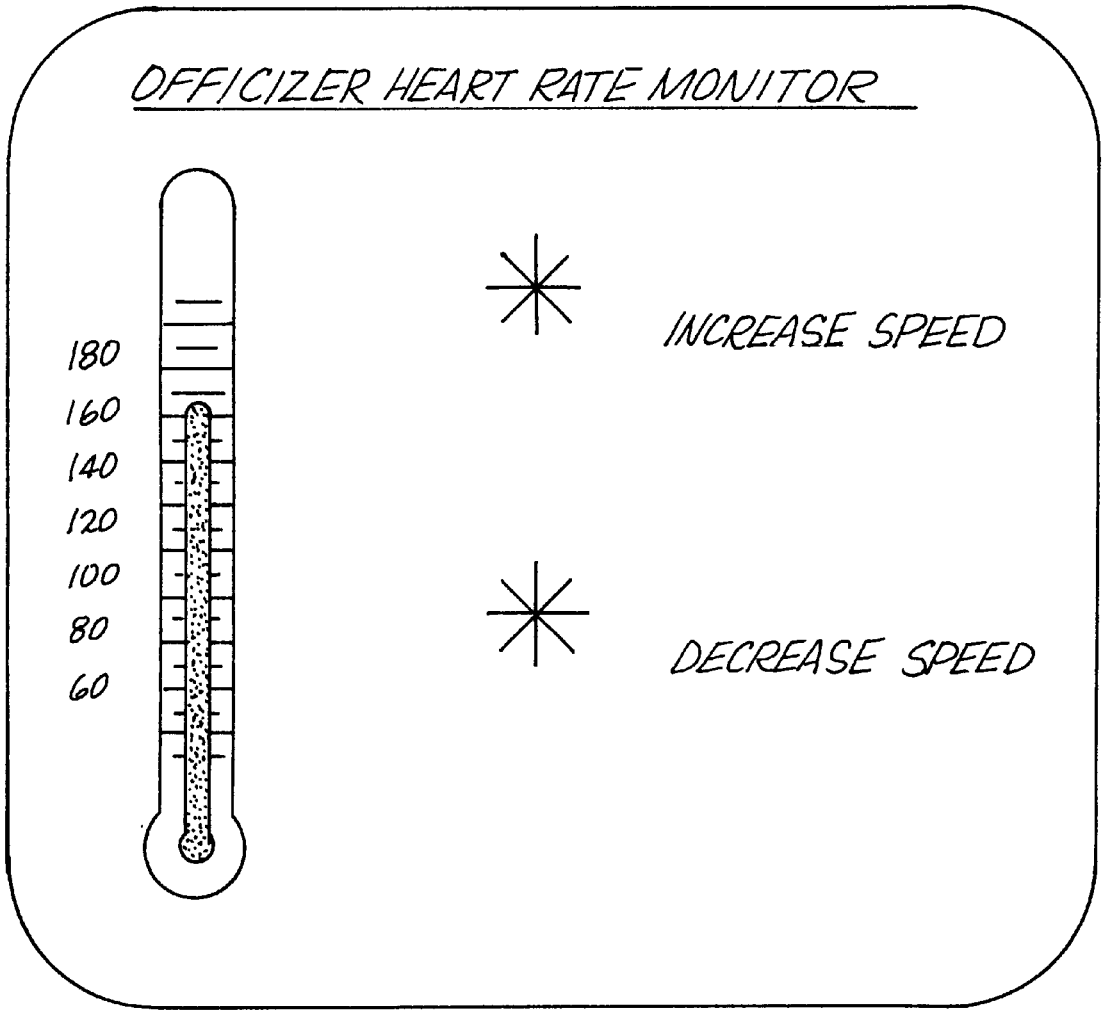

In an alternate embodiment, the user is also provided with a pulse sensor, which may be in the form of a conventional ear or finger clip. Alternatively, the pulse sensor may be incorporated into a mouse (see FIG. 5), which is equipped with a finger surface area containing an IR emitter/detector such as is used in pulse sensor watches made by, for example, Casio. The pulse sensor (and related electronics) is connected to a serial port of the computer, which can also supply operating power (or optional battery power can be used). The program periodically monitors the serial port to determine pulse rate, which is displayed graphically as shown in FIG. 6. The pulse rate is compared to the target rate, and an instruction is flashed on the screen to either increase or decrease exercise speed to maintain the target rate.

More exotic versions are also contemplated, where the counter information is automatically provided to the computer using an RF link between the counter and a serial port connected RF receiver.

What is claimed is:

1. A method of exercising while using a personal computer for non-exercise related tasks, comprising the steps of:

monitoring the level of exercise being performed by the user;

converting the monitored level to a signal which is compatible with the input signal format of the computer;

providing the monitoring signal to an input port of the computer; and providing software to the computer designed to operate in a multi-tasking environment; the software periodically sampling the monitoring signal and multi-tasking the non-exercise related task with a display of information related to the sampled monitoring signal.

2. The method of claim 1 where the step of monitoring the level of exercise includes the step of measuring the pulse rate of the user.

3. The method of claim 2 where the use of the personal computer includes the use of a mouse equipped with a finger surface area, and the step of measuring the pulse rate of the user includes the incorporation of a pulse rate monitor on the finger surface area of the mouse.

4. The method of claim 1, in which the software operates in the background.

5. The method of claim 4, in which the software pops up reminder screens at intervals.

6. The method of claim 5 in which the intervals are set by the user.

7. Apparatus for utilizing a computer to monitor exercise activity of a user of the computer comprising:

means for monitoring the level of exercise being performed by the user;

means for generating a monitoring signal representative of the level of exercise;

a computer having a display screen;

means for programming the computer to operate in a multi-tasking environment such that the monitoring signal is periodically sampled and information related to the sampled signal is displayed on the screen.

8. The apparatus of claim 7, in which the programming means operates in the background to pop up reminders on the screen at intervals.

9. The apparatus of claim 8, in which the intervals of the programming means are set by the user.

10. The apparatus of claim 7, in which the monitoring means measures the pulse rate of the user.

11. The apparatus of claim 10, in which the computer includes a mouse equipped with a finger surface area that includes the monitoring means.

12. The apparatus of claim 7, in which the computer is programmed to display on the screen whether exercise activity should be increased of decreased to maintain a target level of the monitored exercise.

13. The apparatus of claim 12, in which the computer in programmed to display on the screen at the end of a day the total exercise activity of a user.

14. The apparatus of claim 12, in which the computer in programmed to display on the screen a set up menu that personalizes the target level to the user.

* * * * *

UNITED STATES PATENT AND TRADEMARK OFFICE

CERTIFICATE OF CORRECTION

PATENT NO. : 6,117,050
DATED : September 12, 2000
INVENTOR(S) : Roy J. Mankovitz It is certified that error appears in the above-identified patent and that said Letters Patent is hereby corrected as shown below:

Title page,
Item [76], the Inventor should read:
-- Roy J. Mankovitz, 24236 Park
Granada, Calabasas CA (US) --

Signed and Sealed this

Twenty-seventh Day of August, 2002

*Attest:*

*Attesting Officer*

JAMES E. ROGAN
*Director of the United States Patent and Trademark Office*